US006164857A

United States Patent [19]

Wolfarth-Brooks et al.

[11] Patent Number: 6,164,857

[45] Date of Patent: Dec. 26, 2000

[54] CAP WITH EXTENDABLE APPLICATOR

[76] Inventors: Marina Wolfarth-Brooks; DJ Wolfarth-Brooks, both of CMR 475, Box 491, APO, AE 09036, Waldmannshofen, Germany

[21] Appl. No.: 09/597,584

[22] Filed: Jun. 20, 2000

[51] Int. Cl.[7] ..... A46B 11/00

[52] U.S. Cl. ..... 401/127; 401/126

[58] Field of Search ..... 401/127, 126, 401/122, 129, 123; 15/172; 132/75, 73

[56] References Cited

U.S. PATENT DOCUMENTS

| | | | |
|---|---|---|---|
| 68,163 | 8/1867 | Burnet | 401/127 |
| 4,917,520 | 4/1990 | Reid . | |
| 4,990,014 | 2/1991 | O'Neill . | |
| 5,096,320 | 3/1992 | Norman et al. . | |
| 5,116,154 | 5/1992 | Fulkerson . | |
| 5,556,216 | 9/1996 | Mayesh | 401/127 |
| 5,690,441 | 11/1997 | McManus | 401/127 |
| 5,913,631 | 6/1999 | Landry | 401/127 |
| 5,937,869 | 8/1999 | Lhuisset . | |

*Primary Examiner*—Henry J. Recla
*Assistant Examiner*—Huyen Le
*Attorney, Agent, or Firm*—Varndell & Varndell, PLLC

[57] ABSTRACT

An extendable applicator is disclosed for reaching the contents of the lowermost portion of a bottle. The extendable applicator has an upper pushbutton cap that moves up and down within a base cap member and to which an applicator brush is attached. An insert base is arranged within the lower portion of the base cap and has a flat upper surface that, together with the flat bottom of the upper pushbutton cap, supports a coil spring. The insert base also has a hole for the applicator brush to fit through. Finally, the extendable applicator includes a threaded piece for attachment of the extendable applicator to an externally threaded bottle. The applicator brush optionally contains a clear plastic cap to cover the upper pushbutton cap and a lip is provided on the upper external surface of the base cap to accommodate the clear plastic cap.

4 Claims, 2 Drawing Sheets

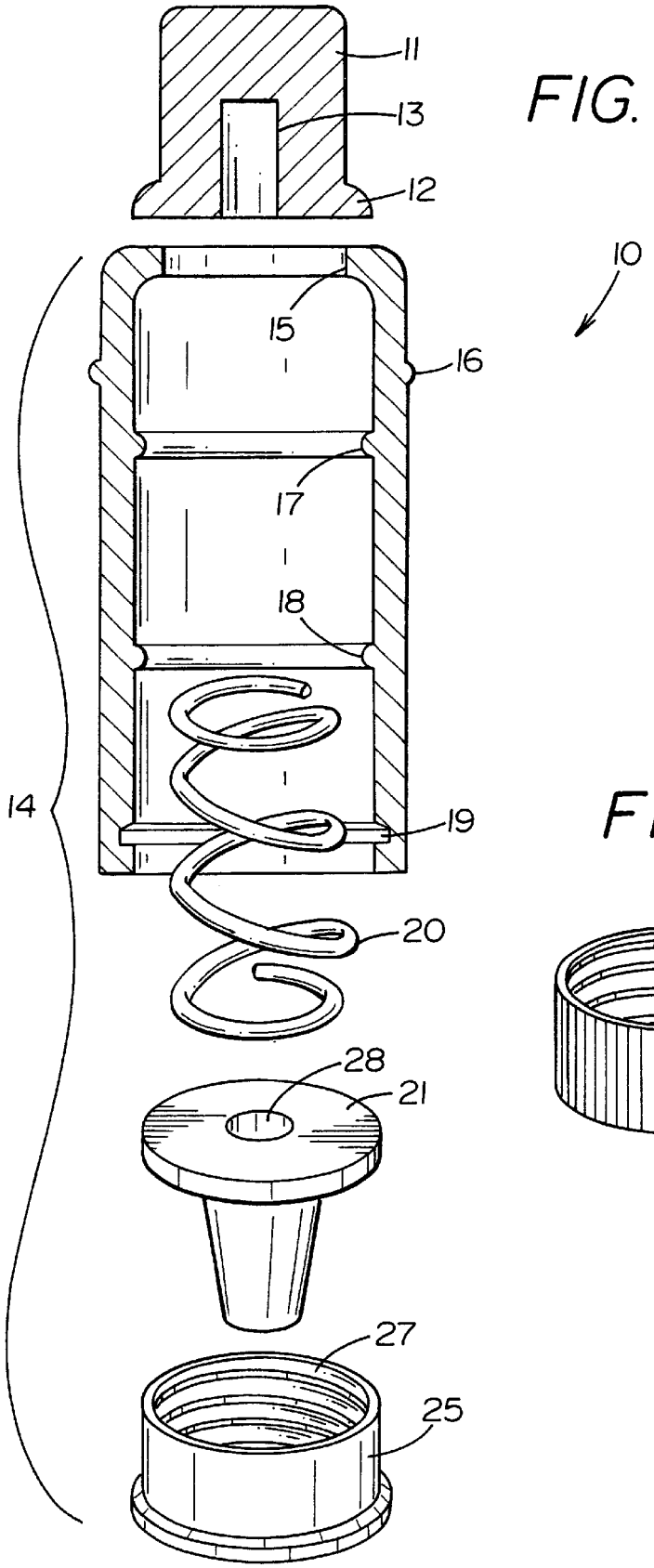
FIG. 3
FIG. 4
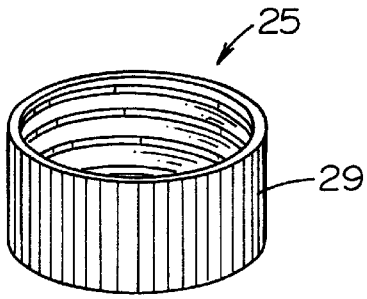

CAP WITH EXTENDABLE APPLICATOR

BACKGROUND OF THE INVENTION

Cap assemblies with attached applicator brushes are widely used for nail polish bottles, small paint jars, and other applications where it is necessary to withdraw a liquid from the interior of a bottle. With prior art cap assemblies, the applicator brush is of a length so that when the cap is secured to a bottle, the brush is not forced into contact with the bottom of the bottle, thereby damaging the brush. By such design, however, the contents of the lowermost portion of the bottle are inaccessible to the brush, thereby causing the user to waste the inaccessible contents of the bottle.

DISCUSSION OF THE PRIOR ART

U.S. Pat. No. 4,917,520, issued to Reid on Apr. 17, 1990, proposes an applicator brush where the brush and cap are rotated axially so that the cap may be depressed, thus permitting the brush to access the contents on the bottom of the bottle. U.S. Pat. 4,990,014, issued to O'Neill on Feb. 5, 1991, proposes a closure assembly to be attached to the open neck of a container where the upper cap of the assembly rotates causing axial displacement of an applicator brush into the container. U.S. Pat. No. 5,096,320, issued to Norman et al. on Mar. 17, 1992, proposes an adjustable brush cap that has an arcuate brush member integrally mounted to a plunger. The structure of this device makes it difficult to manufacture. U.S. Pat. No. 5,116,154, issued to Fulkerson on May 26, 1992, proposes a cap assembly that uses a spring to enable a brush to remain relatively stationary with respect to the bottom of a container while a cap is threaded onto the container.

SUMMARY OF THE INVENTION

The present invention relates to the field of applicator brushes. More specifically, the invention is concerned with cap assemblies comprising integral brush members that are used to withdraw liquid from a bottle. The extendable applicator of the present invention overcomes the disadvantages of the prior art cap assemblies by providing, in the retracted position, an applicator brush that can be secured to a bottle so that the brush does not come into contact with the bottom of a bottle, but also provides, in the extended position, an applicator brush capable of reaching the contents in the lowermost position of a bottle. The extendable applicator of the invention comprises an upper pushbutton cap that moves up and down within a base cap member and to which an applicator brush is attached. Within the lower portion of the base cap is an insert base having a flat upper surface that, together with the flat bottom of the upper pushbutton cap, supports a coil spring. The insert base also comprises a hole for the applicator brush to fit through. The extendable applicator comprises a threaded piece for attachment of the extendable applicator to an externally threaded bottle. The applicator brush optionally contains a clear plastic cap to cover the upper pushbutton cap. A lip can be provided on the upper external surface of the base cap to accommodate the plastic cap.

BRIEF DESCRIPTION OF THE DRAWINGS

FIG. 3 is an exploded perspective view of the extendable applicator of the present invention.

FIG. 4 is a perspective view of an alternative embodiment of the inserted thread piece according to the present invention.

DESCRIPTION OF THE PREFERRED EMBODIMENT

Figure 1:
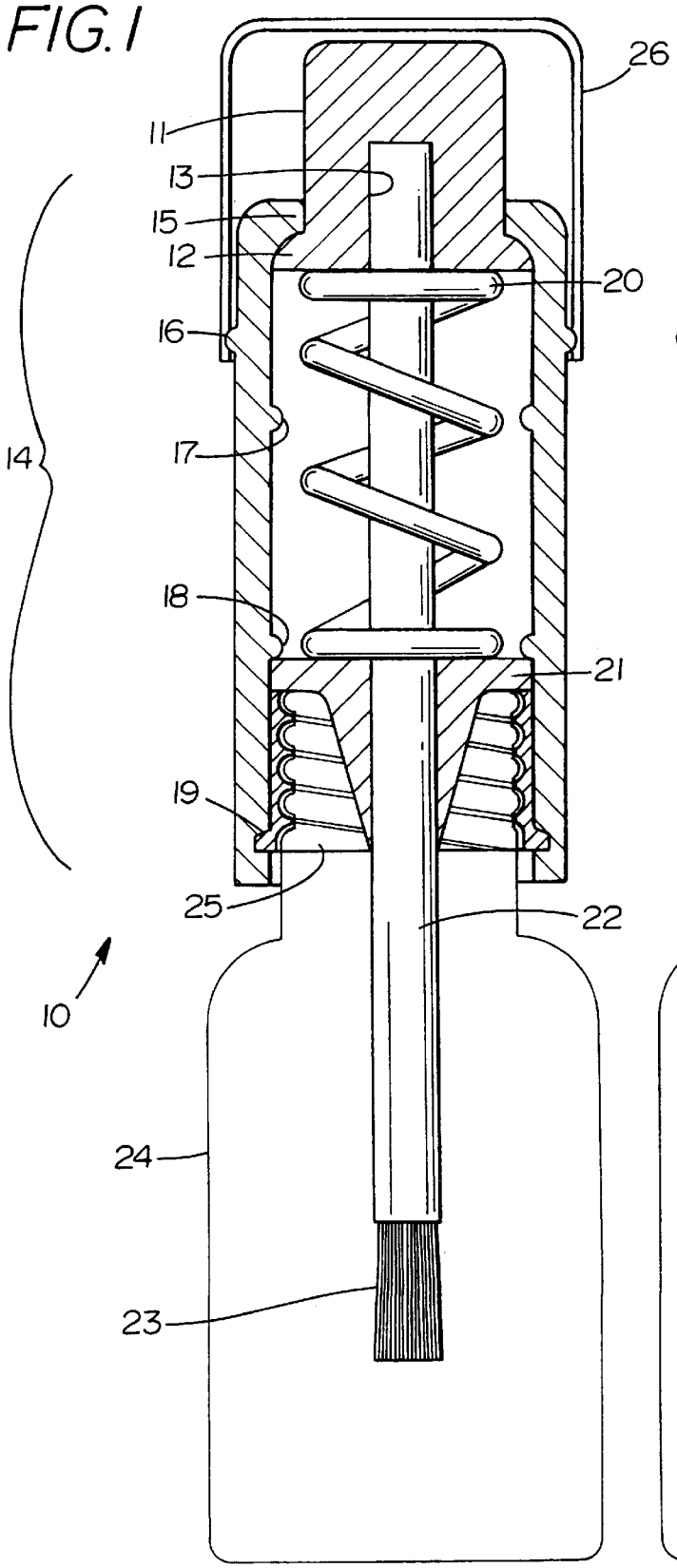
FIG. 1 is a cross-sectional view of an extendable applicator according to the present invention in the retracted position.

The present invention provides an extendable applicator for attachment to an externally threaded neck of a bottle or other container. The extendable applicator can comprise an upper pushbutton cap, a base cap, an insert base, a threaded piece, a spring (such as a coil spring) and an applicator brush. The upper pushbutton cap can fit within the base cap. The applicator brush can be secured to the upper push button cap. The upper pushbutton cap moves up and down within the base cap, thereby moving the applicator brush within a bottle and relative to the bottom of the bottle. The base cap can further comprise an insert base that has a flat top that, together with a flat top of the upper pushbutton cap, houses a spring that permits the extension and retraction of the applicator brush. The insert base having a flat top is tapered and has a hole through its center to accommodate and guide the applicator brush into the bottle. The extendable applicator can be provided with a threaded piece. The threaded piece can have the form of a hollow cylinder with interior threads to permit the extendable applicator assembly to be attached to an externally threaded neck of a bottle. The threaded piece can have a ribbed exterior to secure the piece within the base cap. The extendable applicator can also contain a plastic cap to cover the upper pushbutton cap.

In as much as the foregoing has outlined rather broadly the more pertinent and important features of the present invention, the following detailed description of the invention is provided, so that the present contribution to the art can be more fully appreciated. It should be appreciated by those skilled in the art that the conception and the disclosed specific structures may be readily utilized as a basis for modifying or designing other structures for carrying out the same purposes of the present invention. It should be realized by those skilled in the art that such equivalent methods and structures do not depart from the spirit and scope of the invention.

It is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

A significant object of the invention is to provide an extendable applicator that permits an applicator brush to be extended so that the contents of the lowermost portion of a bottle are accessible to the brush. Another significant object of the invention is to additionally provide an applicator that, when attached to a bottle provides that the applicator brush does not come in direct contact with the floor of a bottle, thereby preventing deformation of the brush.

Figure 2:
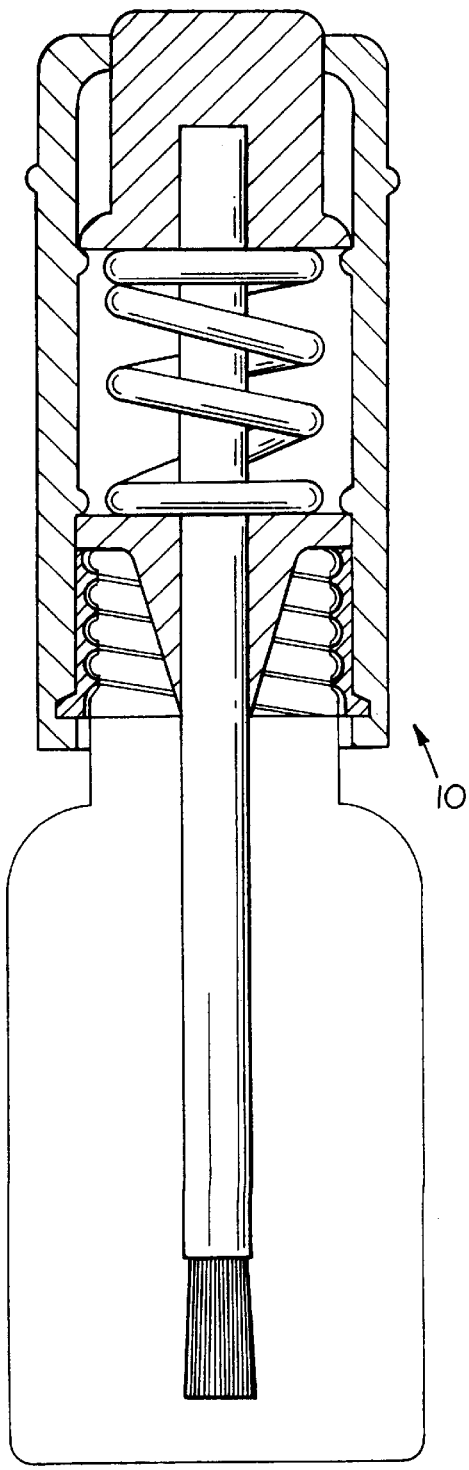
FIG. 2 is a cross-sectional view of an extendable applicator according to the present invention in the extended position.

FIG. 1, FIG. 2 and FIG. 3 illustrate a typical embodiment of the extendable applicator of the present invention. The present invention can include an applicator 10, which comprises a upper pushbutton cap 11, a base cap 14, an insert base 21, a coil 20 (such as a coil spring), an applicator brush 22 and an inserted thread piece 25.

The upper pushbutton cap 11 can include a cylindrical side wall with an outwardly extending flange 12 on the lower portion thereof. The flange 12 can be arranged at the bottom of the cap 11, as shown in FIG. 1, or elsewhere along the length of the cylindrical wall. The bottom of the cap 12 can be flat. A hole 13 can be provided along an axis of the upper pushbutton cap 11 for accommodating the applicator brush 22, such as along a center axis of the cylindrical side wall. The hole 13 can extend from the bottom of the upper pushbutton cap 11 approximately halfway up the inside of the cap 11, such as shown in FIGS. 1 and 2.

The base cap 14 can include an inward flange 15 on the upper inside portion of thereof. This flange can have slope matching or corresponding to that of the flange 12 of the upper pushbutton cap 11, so that they fit tightly together. The inward flange 15 functions to retain the upper pushbutton cap 11 within the base cap 14. The top of the base cap 14 is provided with an opening, such as a circular hole, that matches the shape of the upper portion of the upper pushbutton cap 11, so that the upper pushbutton cap 11 can smoothly slide with the base cap 14. The spring biases the upper pushbutton cap 11 outward (or upward as shown in FIGS. 1 and 2), and the inward flange 15 holds the upper pushbutton cap 11 within the base cap 14 against the action of the spring 20. The shape of the bottom of the upper pushbutton cap 11, such as the part containing the flange 15, should match the interior dimensions of the base cap 14. This structure also assists with the upper pushbutton cap 11 sliding smoothly within the base cap 14. The base cap 14 can additionally include a stopper, such as lip 17, on its inner surface for limiting the amount of downward movement of the upper pushbutton cap 11. The applicator brush 22 is secured to the hole 13 in the upper pushbutton cap 13 by gluing or other suitable means. With this arrangement, the stopper or lip 17 on the inner surface of the base cap 14 can function to limit the downward movement of the applicator brush 22, so that it will not contact the bottom of the bottle 24.

The outward flange 12 of the upper pushbutton cap 11 and the stopper or lip 17 of the base cap 14 can be constructed, so that the flange 12 can slide past the lip 17 during the manufacturing process with a slight force from behind. The base cap 14 can also comprises a second stopper, such second lip 18, on the inner surface of the base cap 14 to limit the maximum distance the insert base 21 can travel upwards in the base cap 14, when the insert base 21 is inserted in the base cap 14 during a process of manufacturing the cap of the present invention.

A threaded piece 25 can be inserted into the bottom of the base cap and held in place by friction, glue or other means. The threaded piece 25 can have a structure corresponding to the threaded portion of the neck of the bottle 24, so that the applicator 10 can be tightly screwed on the bottle 24 in an airtight manner. The base cap 14 can be provided a slot 19, and the threaded piece 25 can be provided with a flange that fits into the slot. After the flange of the threaded piece 25 is placed within the slot 19, the threaded piece 25 and the insert base 21 are secured in place.

Alternatively, the base cap 14 can include a cylindrical structure with two different diameters. For example, a bottom portion of base cap 14 can have a larger diameter than an upper portion thereof. With this structure, the base cap 14 can be molded so that the threaded piece 25 is molded therewith. In other words, the base cap 14 and threaded piece 25 can be integrally formed by molding. With this arrangement, the diameter of bottom portion of base cap 14 should be large enough so that the both the upper pushbutton cap 11 and insert base 21 can be inserted into the base cap and past the threads of the integrally formed piece. Also, in this arrangement, the second stopper or the lip 18 can serve to secure the insert base 21 in place. For example, the applicator 11 can be manufactured by firstly securing the applicator brush 22 in the hole 13 of the upper pushbutton cap 11. Then the upper pushbutton cap 11 is slid past the first and second stoppers (or the lips 17, 18), so that the outward flange 12 of the upper pushbutton cap 11 abuts the inward flange 15 on the upper inside of the base cap 14. The spring 20 is slid over the applicator brush 22, so as to abut the upper pushbutton cap 11. The insert base 21 is slid over the applicator brush 22 and secured behind the second stoppers or lip 18, where it slightly compresses the coil spring 20 and is held in place.

In a preferred embodiment, the extendable applicator can further comprises a plastic cap 26. The cap is preferably clear plastic. The base cap 14 can comprises a lip 16 on the upper outside portion thereof onto which the plastic cap 26 snaps down.

The insert base 21 of the extendable applicator can have an inverted cone shape with a flat top. The flat top can have circular flange that tightly fits within the base cap 14. The inverted cone shape or a tapered neck provides the function of the guiding the brush into top opening of the bottle (24). The insert base 21 has a hole 28 provided along its longitudinal axis (i.e., along the axis of the inverted cone). The hole 28 should be large enough to accommodate an applicator brush 22. The flat bottom of the upper pushbutton cap 11 and the flat top of the insert base 21 provide surfaces for the coil spring 20.

The applicator brush 22 can be secured into the hole 13 in the bottom of the upper push cap 11, for example, by glue. It is also possible that the upper pushbutton cap and applicator brush can be made of a single piece of material, such as by plastic molding, or can be made separately and combined together by convenient means of manufacture. The distal end of the applicator 22 is provided with brush bristles 23.

The bottle 24 to be used with the extendable applicator of the present invention may be of any shape, provided the brush can extend down to reach the contents of the lowermost portion of the bottle. The bottle can have an externally threaded neck onto which the applicator is secured.

The threaded piece 25 of the present invention can snap into the base cap 14 and is internally threaded 27 (best seen in FIG. 3) to provide means for attaching the extendable applicator assembly 10 to bottle 24. In one embodiment shown in FIG. 4, the external surface of the threaded piece is ribbed 29 to aid in securing the piece 25 in the base cap 14 by friction. Alternatively, the threaded piece 25 can be glued into the base cap 14.

While the invention has been illustrated and described in detail in the drawings and foregoing description, the same is to be considered as illustrative and not restrictive in character. Only the preferred embodiment has been shown and described in that all changes and modifications that come within the spirit of the invention are desired to be protected. With respect to the above description then, it is to be realized that all equivalent relationships to those illustrated in the drawings and described in the specification are intended to be encompassed by the present invention.

What we claim is:

1. An extendable applicator for attachment to a bottle, the applicator comprising an upper pushbutton cap and a base cap:

the upper pushbutton cap having a flat bottom with a center hole, an outward flange, and an applicator brush having a stem with first and second ends, the first end of the stem having bristles and the second end of the stem of the applicator brush secured in the center hole of the pushbutton cap;

the base cap having a hollow middle with an inner surface, an inward flange arranged on an upper portion of the inner surface of the base cap, a first stopper and a second stopper arranged in a middle portion of the inner surface of the base cap, the first stopper being closer to the inward flange than the second stopper, a spring; an insert base with a flat end, a tapered end, and a center hole; and a threaded piece having interior treads for screwing onto matching threads of a bottle;

wherein the upper cap is received in and slides within the base cap, the spring is arranged to force the upper pushbutton cap out of the base cap, the inward flange of the base cap cooperates with the outward flange of the upper pushbutton cap to keep a portion of the upper pushbutton within the base cap and to counter the force of the spring, and the stopper cooperates with the flat bottom of the upper pushbutton cap to limit movement of the upper pushbutton cap against the force of the spring;

the insert base and threaded piece are arranged in the bottom portion of the base cap with the flat end the insert base abutting the second stopper and being secured in the base cap by the threaded piece, the spring having one end abutting the flat end of the insert base and an opposite end abutting the bottom of the upper pushbutton cap, and the stem of the applicator brush passes through the center hole of the insert base and extends out of the base cap, so that the upper pushbutton cap can move against the force of the spring thereby changing a length of the stem of the applicator bush extending out of the base cap.

2. The extendable applicator for attachment to a bottle according to claim 1, further comprising a slot arranged in a bottom portion of the inner surface of the base cap, the slot cooperating with a corresponding protrusion on the threaded piece to secure the threaded piece within the base cap.

3. The extendable applicator for attachment to a bottle according to claim 1, wherein the threaded piece further comprises a ribbed exterior for securing the threaded piece to the base cap.

4. The extendable applicator for attachment to a bottle according to claim 1, wherein the extendable applicator further comprises a plastic cap covering the upper pushbutton cap, and the base cap further comprises a lip on an outer upper edge thereof for securing the plastic cap on the base cap.

* * * * *